US006634184B2

(12) United States Patent
Feldman

(10) Patent No.: US 6,634,184 B2
(45) Date of Patent: Oct. 21, 2003

(54) PRONGLESS GEMSTONE SETTING

(75) Inventor: William Feldman, Cranston, RI (US)

(73) Assignee: Hord Crystal Corporation, Pawtucket, RI (US)

( * ) Notice: Subject to any disclaimer, the term of this patent is extended or adjusted under 35 U.S.C. 154(b) by 0 days.

(21) Appl. No.: 10/064,114

(22) Filed: Jun. 12, 2002

(65) Prior Publication Data

US 2003/0101747 A1 Jun. 5, 2003

Related U.S. Application Data

(60) Provisional application No. 60/337,020, filed on Dec. 3, 2001.

(51) Int. Cl.[7] ..... A44C 17/02

(52) U.S. Cl. ..... 63/26; 63/3; 63/4; 63/27; 63/28; D11/91; D11/92

(58) Field of Search ..... 63/26, 27, 28, 63/3, 4; D11/91, 92

(56) References Cited

U.S. PATENT DOCUMENTS

| | | | | | |
|---|---|---|---|---|---|
| 1,200,463 | A | * | 10/1916 | Brettner | 59/80 |
| 1,544,619 | A | | 7/1925 | Wakefield | |
| 1,573,927 | A | * | 2/1926 | Fulford | 59/80 |
| 1,589,423 | A | | 6/1926 | Payton | |
| 2,510,774 | A | * | 6/1950 | Engel | 63/26 |
| 2,634,593 | A | * | 4/1953 | Moretti | 63/4 |
| 2,920,442 | A | | 1/1960 | Kunzmann et al. | |
| D199,322 | S | * | 10/1964 | Katz | D11/89 |
| 3,339,378 | A | * | 9/1967 | Chirol | 63/28 |
| 4,292,818 | A | | 10/1981 | Vitau | |
| D265,641 | S | * | 8/1982 | Bongiorno | D11/92 |
| 4,972,685 | A | | 11/1990 | Poll | |
| 5,285,659 | A | | 2/1994 | Bardisbanyan | |
| 5,419,159 | A | | 5/1995 | Muller | |
| 5,694,791 | A | * | 12/1997 | Esposito | 63/3 |
| 6,412,303 | B1 | * | 7/2002 | Lee | 63/3 |

* cited by examiner

*Primary Examiner*—Andrea Chop
(74) *Attorney, Agent, or Firm*—Barlow, Josephs & Holmes, Ltd.

(57) ABSTRACT

A prongless setting for mounting a gemstone and a method of manufacturing the same. The setting includes a base that is formed from a flat piece of metal, which is bent into the shape of a box having an open top. Two arcuate members are provided along the top edges of the box. A gemstone is placed into the open top of the box and the two arcuate members are bent over the top of the stone to retain it in the setting. Also, the method of stamping the blank that is suited for bending into the setting described above. Finally, forming a chain using a plurality of settings and gemstones that can be further incorporated into a finished piece of jewelry.

18 Claims, 9 Drawing Sheets

PRONGLESS GEMSTONE SETTING

CROSS REFERENCE TO RELATED APPLICATIONS

This application claims the benefit of U.S. Provisional Patent Application Serial No. 60/337,020, filed Dec. 3, 2001, incorporated herein by reference.

BACKGROUND OF INVENTION

The instant invention relates to settings for gemstones, such as box-type gemstone settings, and more particularly relates to box-type gemstone settings that are linked together form a continuous jewelry chain and typically sold in continuous spool form. Even more specifically, the present invention is related to the manufacture of rhinestone jewelry chain.

In the prior art, a typical box-type setting for a gemstone includes four prongs for holding the stone in the setting (See FIG. 1). There is typically a prong located at each corner of the setting, and each prong is bent over the top of the stone to retain the stone within the setting. Although this arrangement has been used for many years, one particular issue continues to create a problem with the use of this type of setting, namely, that the prongs still catch on various loose-knit clothing fabrics. Even though the prongs are bent over on top of the stone as described above, the terminal ends of the prongs are still exposed and project slightly from the top of the stone. This slight projection causes the prongs to occasionally to catch on, and pull, various types of loose-knit fabrics, such as sweaters. Further, if the prongs are caught or snagged, they may bend away from the stone, thus no longer retaining the stone and causing the stone to fall out of the setting.

Other types of prior art settings include a concealed-type setting where the stone is grooved along opposing facets on the underside of the gemstone. While this type of setting prevents any exposed prongs from snagging the clothing of the wearer, it requires that the stones be specially manufactured. Furthermore, this type of grooving requires additional labor in the cutting of the gemstone and is only suitable for square or rectangular gemstones.

Another type of gemstone setting is referred to a bezel setting where the entire edge of the stone is retained by bending the edge of the setting over the perimeter of the top of the gemstone. This is a very effective method of retaining a gemstone within a setting and it provides a great deal of protection for the stone. The drawback to this type of setting is that it conceals both the edge and a portion of the top face of the stone. By concealing the stone in this manner, it causes the stone to appear smaller and prevents some of the light that enters the stone from reflecting back out.

Yet another type of setting in the prior art is a two-piece setting. A first piece of the setting retains two opposing edges of the gemstone and is placed within a second piece that retains the other two sides of the stone and also provides the linking elements. This type of setting has the same drawbacks as the bezel setting described above, in addition to having two pieces that add to the complexity of forming the setting and the labor required for assembly.

SUMMARY OF INVENTION

The present invention provides an improved setting for a gemstone that overcomes the deficiencies noted above. In the present invention, the conventional gemstone setting method of using four prongs to retain the stone is replaced using a pair of arcuate loops that form curved bars which are then bent over on top of the stone.

The first step in forming the gemstone setting of the present invention begins with forming a blank. The blank is stamped from a flat piece of sheet metal and has a main body, four tabs and two crescent shaped loops that extend outwardly from the opposing sides of the main body. The tabs are bent upwardly relative to the ends of the main body and the ends of the main body are bent upwardly, whereby the ends of the main body form two sides of a box setting and the tabs form the remaining two sides to complete the box. The crescent loops extend above the sides of the box.

Once the box is formed, a gemstone is set into the open top of the box and the crescent loops are bent down over the top of the gemstone to retain the stone in the setting. In this manner, the crescent loops retain the gemstone and serve the same function that the prongs served in the prior art. However, since the present invention does not use prongs, there are no exposed terminal ends to snag loose-knit fabrics. Further, since there are no exposed terminal ends of the prongs, it is less likely that the retaining elements of setting will be accidentally bent causing the stone to come loose.

A plurality of box-type settings formed in accordance with the present invention can be connected together using linking elements to create a chain. In this fashion, the manufacturer can produce a continuous chain of set gemstones that can be used by jewelry designers and assemblers for incorporation into finished jewelry articles.

It is therefore an object of the present invention to provide a gemstone setting that has a reduced tendency to snag the garment of the wearer. It is a further object of the present invention to provide a gemstone setting that provides additional security for retaining the gemstone within the setting. It is yet another object of the present invention to provide a setting for a gemstone that is snag free while in turn minimizing the amount of setting material that covers and conceals the gemstone.

Other objects, features and advantages of the invention shall become apparent as the description thereof proceeds when considered in connection with the accompanying illustrative drawings.

BRIEF DESCRIPTION OF DRAWINGS

In the drawings which illustrate the best mode presently contemplated for carrying out the present invention.

DETAILED DESCRIPTION

Figure 1:
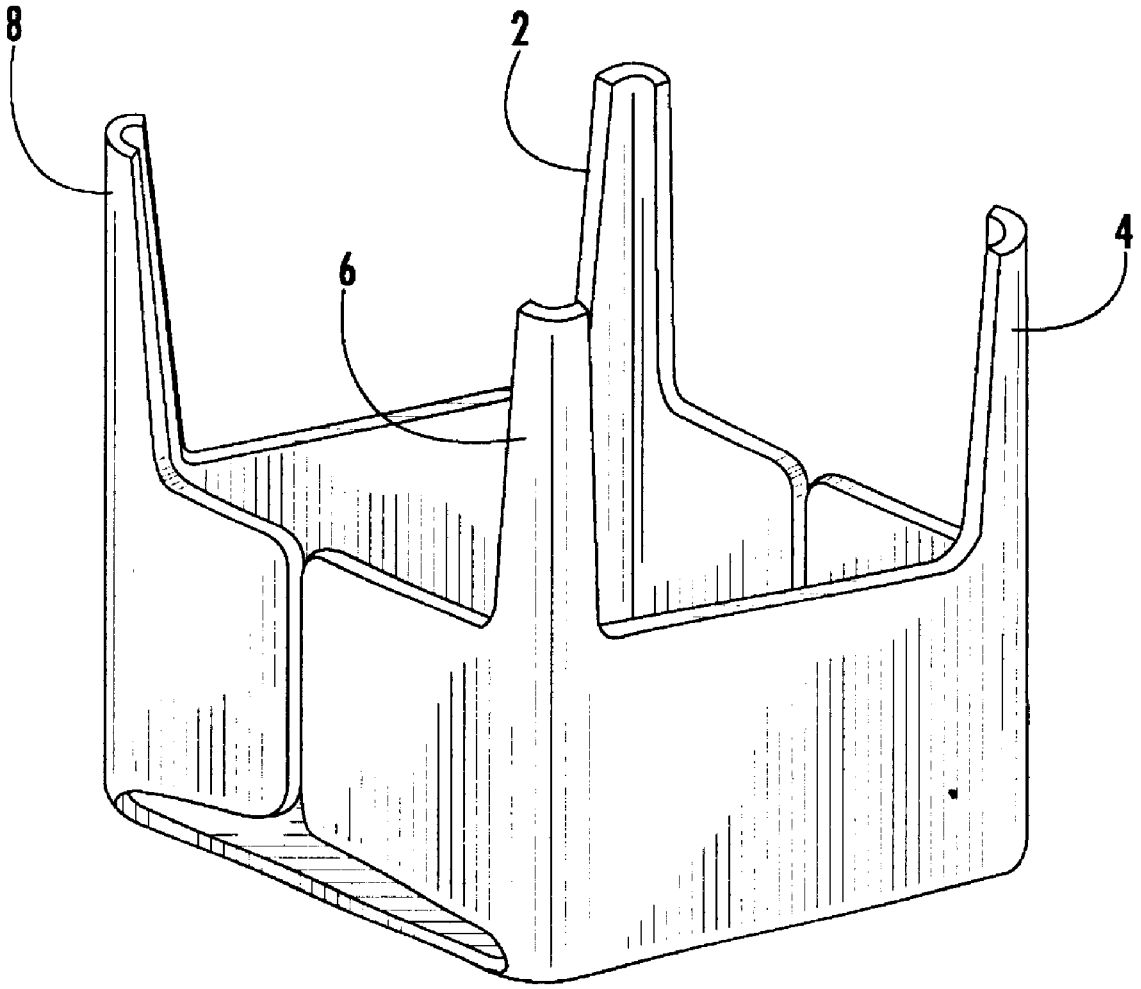
FIG. 1. (PRIOR ART)
FIG. 1 is a perspective view of a box-type gemstone setting with individual prongs as used in the prior art.

Referring now to the drawings, the prongless gemstone setting of the present invention is illustrated and generally indicated at 10 in FIGS. 3–8. As will hereinafter be more fully described, the present invention provides a new mounting method and structure for holding a gemstone within a setting to provide a useful, novel and improved snag-free gemstone setting.

Figure 2:
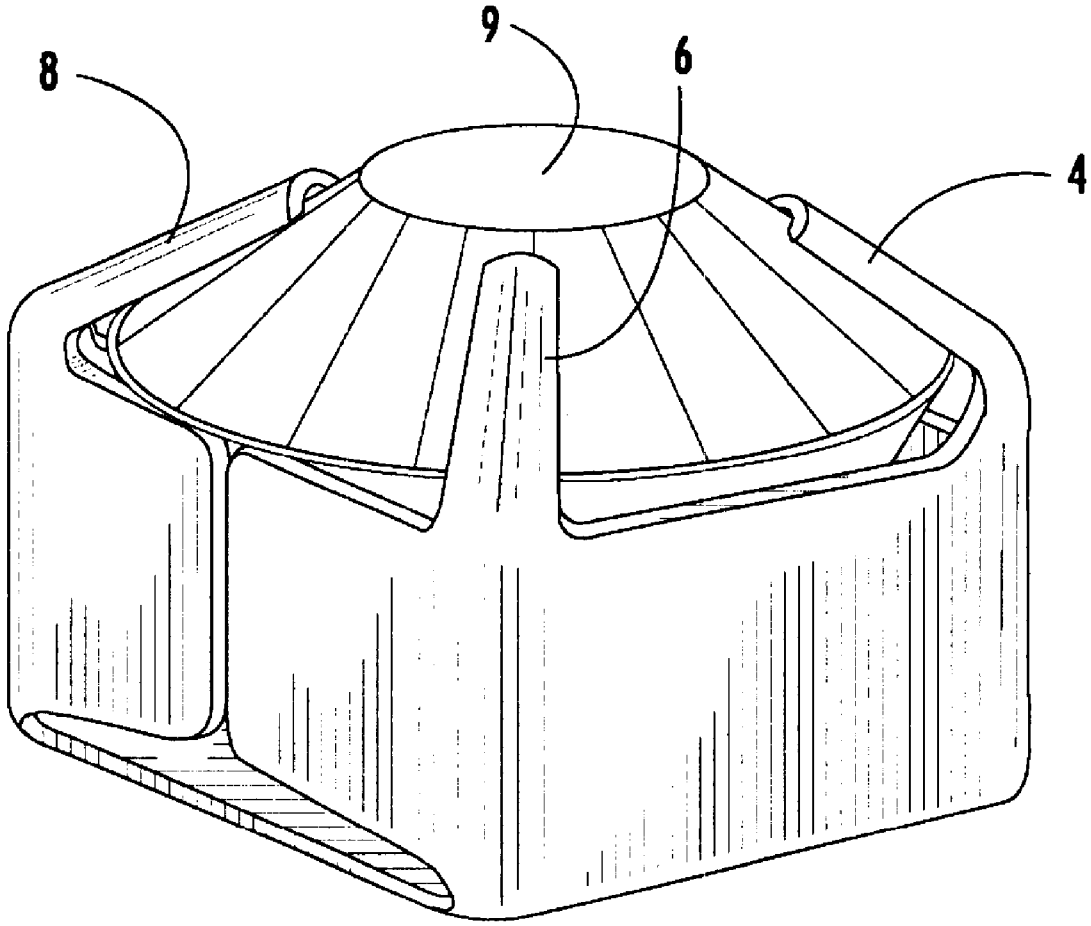
FIG. 2. (PRIOR ART)
FIG. 2 is a perspective view thereof with a gemstone installed.

As can be seen in FIGS. 1 and 2, a representative prior art box-type gemstone setting includes prongs 2, 4, 6, 8 that are bent down on top of a gemstone 9 to retain the stone 9 in the setting. While the prongs 2, 4, 6, 8 are effective to retain the gemstone 9, they in turn create four exposed points that are susceptible to being caught in the fabric weave of the garment of a person who is wearing a piece of jewelry employing this type of setting. Further, in addition to the possibility of snagging a garment and causing a pull in the fabric, if one or more of the prongs 2, 4, 6, 8 gets caught on a garment in this manner, it may become bent, and thus permit the gemstone to fall out of the setting. The result is that both the garment and the jewelry article become damaged.

Figure 3:
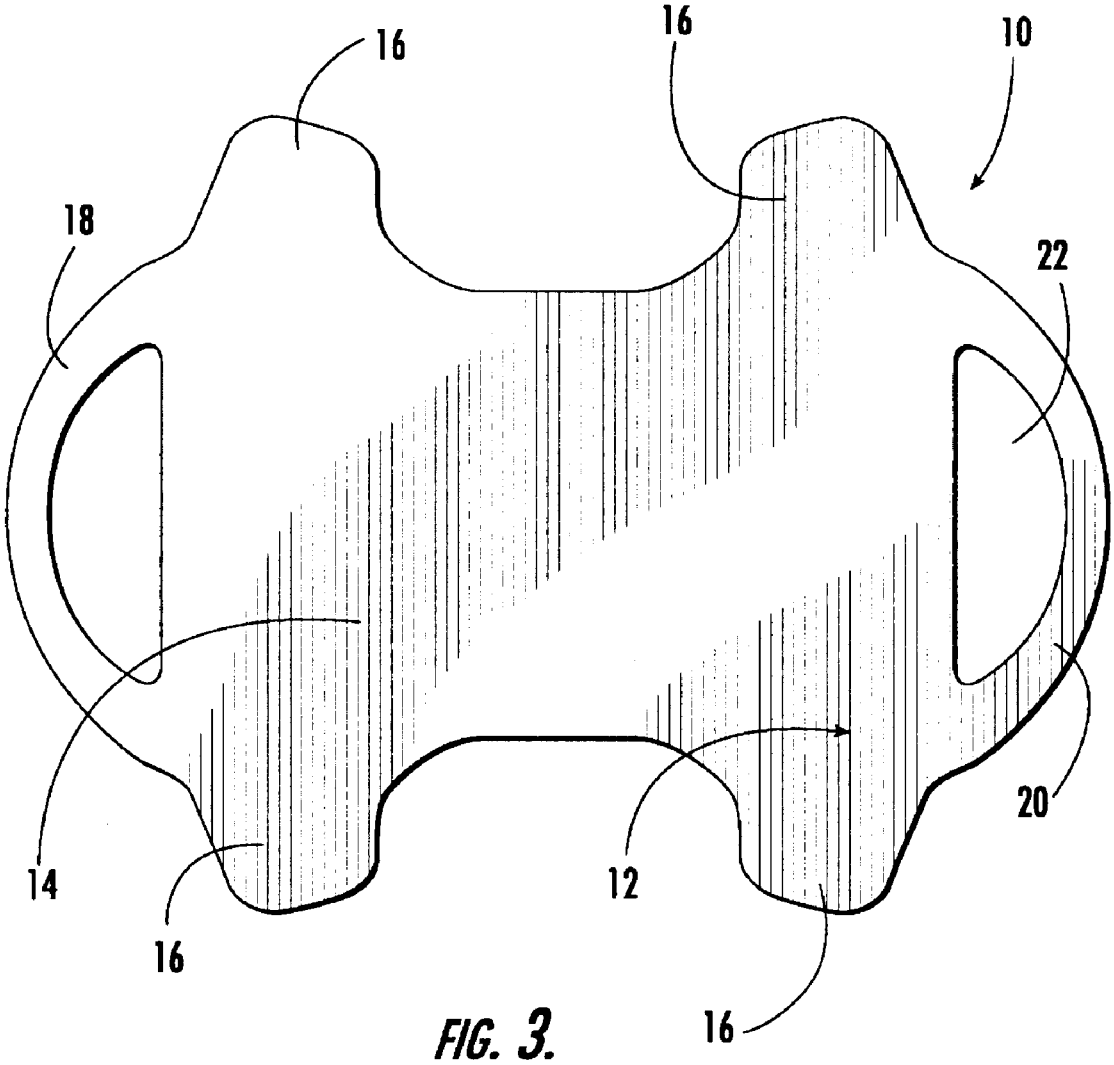
FIG. 3 is a plan view of the stamped blank used to form the improved box-type setting of the present invention.

Turning now to FIG. 3, the prongless gemstone setting 10 of the present invention is fabricated by beginning with a flat metal blank 12 that is stamped from a flat piece of sheet metal. The raw metal stock for the blank 12 may be a sheet of steel, copper, nickel, aluminum, brass or other precious or non-precious metals or metal alloys. This sheet stock is stamped in a stamping press, as is well known in the art, in a fashion that produces a blank 12 shaped as shown in FIG. 3.

The blank 12 has a substantially rectangular central portion 14 that forms the bottom and two sides of the setting box as will be further described below. Along the top and bottom edges of the rectangular central portion, are four protruding tabs 16. These tabs 16, when folded as described below form the remaining two sides of the box setting. On the left and right sides of the rectangular central portion 14 are two arcuate loops 18, 20 that form the means for retaining the gemstone within the setting. The loops 18, 20 protrude outwardly in a crescent shape from the central portion 14 leaving an open gap 22 between respective loops 18, 20 and the central portion 14. The unique shape of the blank 12 is an important aspect of the present invention as it integrally includes all of the components required to form all of the sides of the box setting as well as integral components for retaining a gemstone, all in a one-piece design that can be stamped in a one step process.

Figure 4:
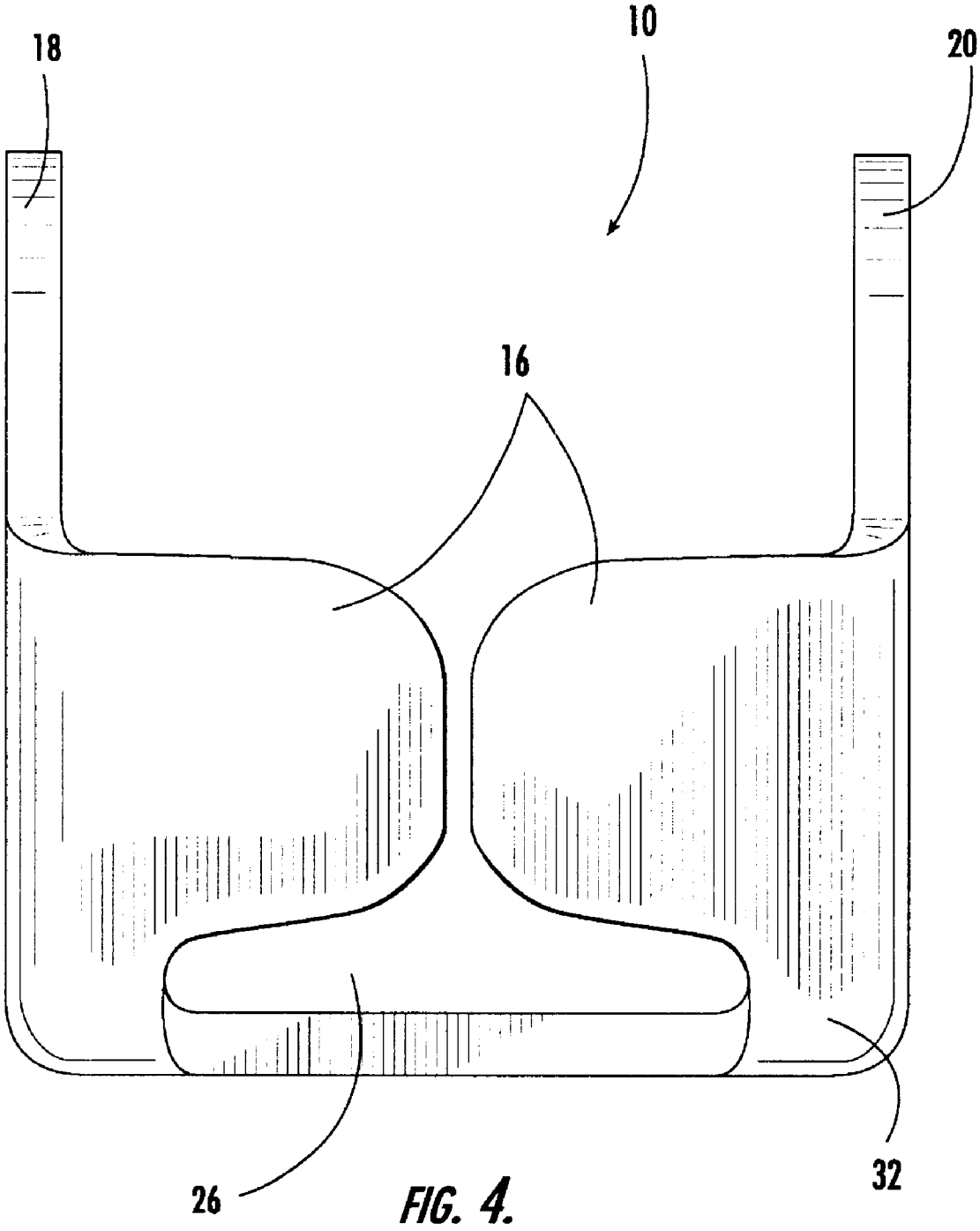
FIG. 4 is a front view of the improved box-type setting in a folded condition with the setting loops in an upright position.
Figure 5:
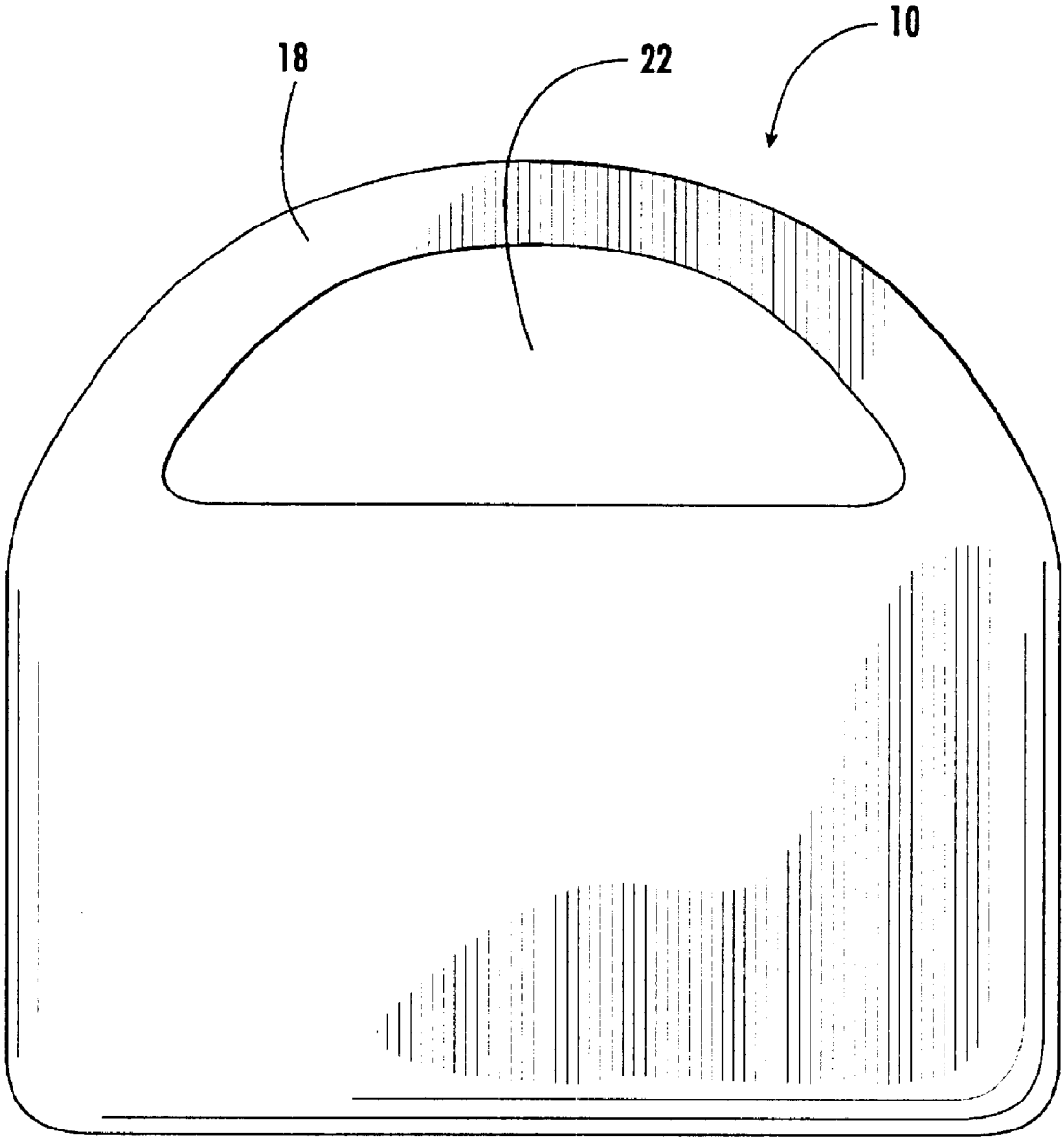
FIG. 5 is a side view thereof.
Figure 6:
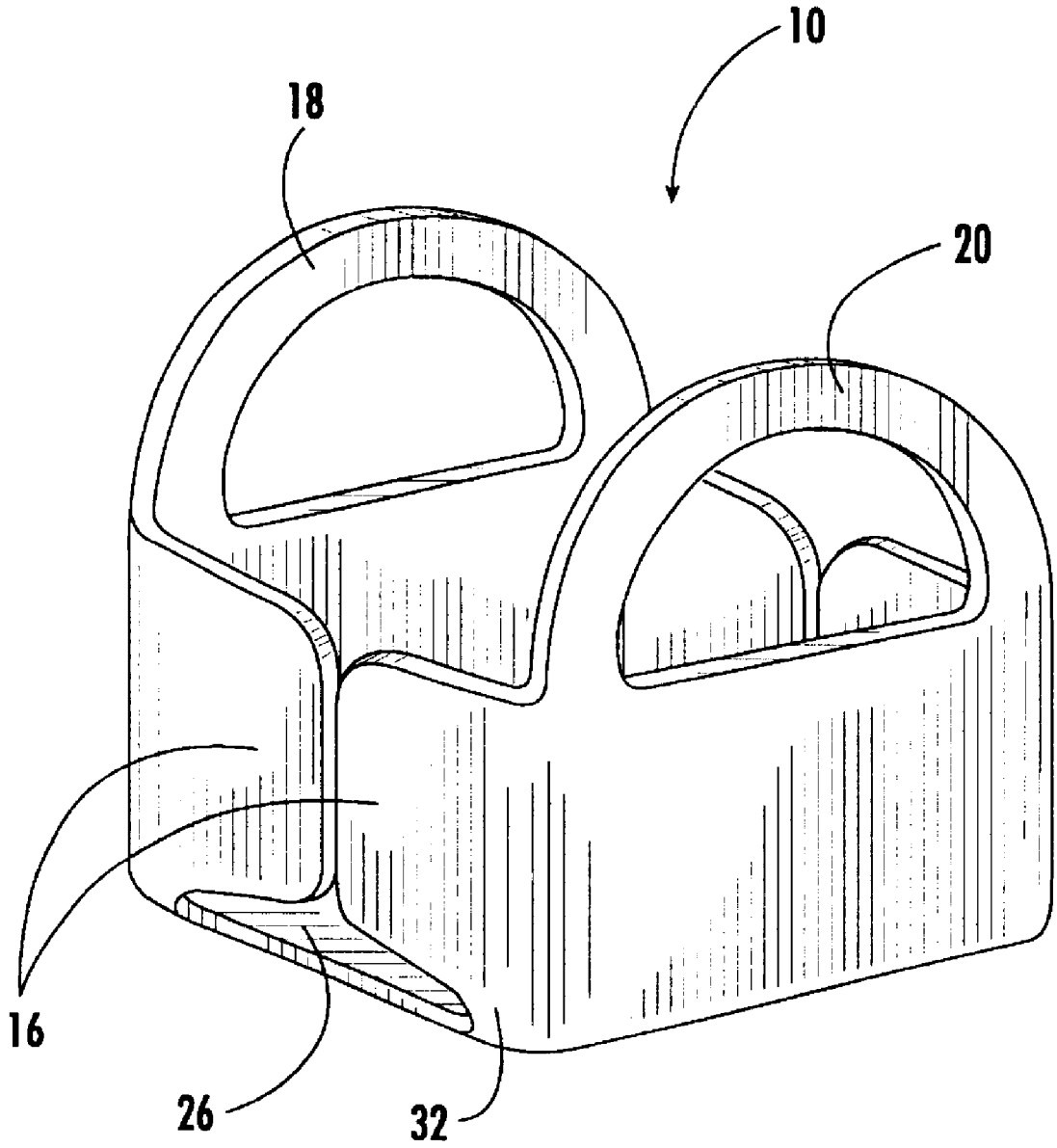
FIG. 6 is a perspective view thereof.

Once the blank 12 is stamped, it may be further processed in some fashion, such as plating, before being bent into a box setting. In FIGS. 4, 5 and 6, the gemstone setting 10 of the present invention is shown after being bent into the preliminary form of the box setting, i.e. ready to receive a gemstone 24. In the bending step, the four tabs 16 along the sides of the rectangular central portion 14 are bent upwardly to a position that is nearly perpendicular to the plane of the blank 12. After the tabs 16 are bent, the two ends of the rectangular central portion 14 are also bent upwardly bringing the two sets of opposing tabs 16 together near the center of the box setting 10. After these bends are made, it can be seen that two opposing sides of the box setting 10 are formed by the four tabs 16 and the other opposing sides are formed by the ends of the central portion 14. Further, the two arcuate loops 18, 20 can now be seen to protrude from the sides of the setting 10. In this fashion, the setting 10 is ready to receive a gemstone.

Figure 7:
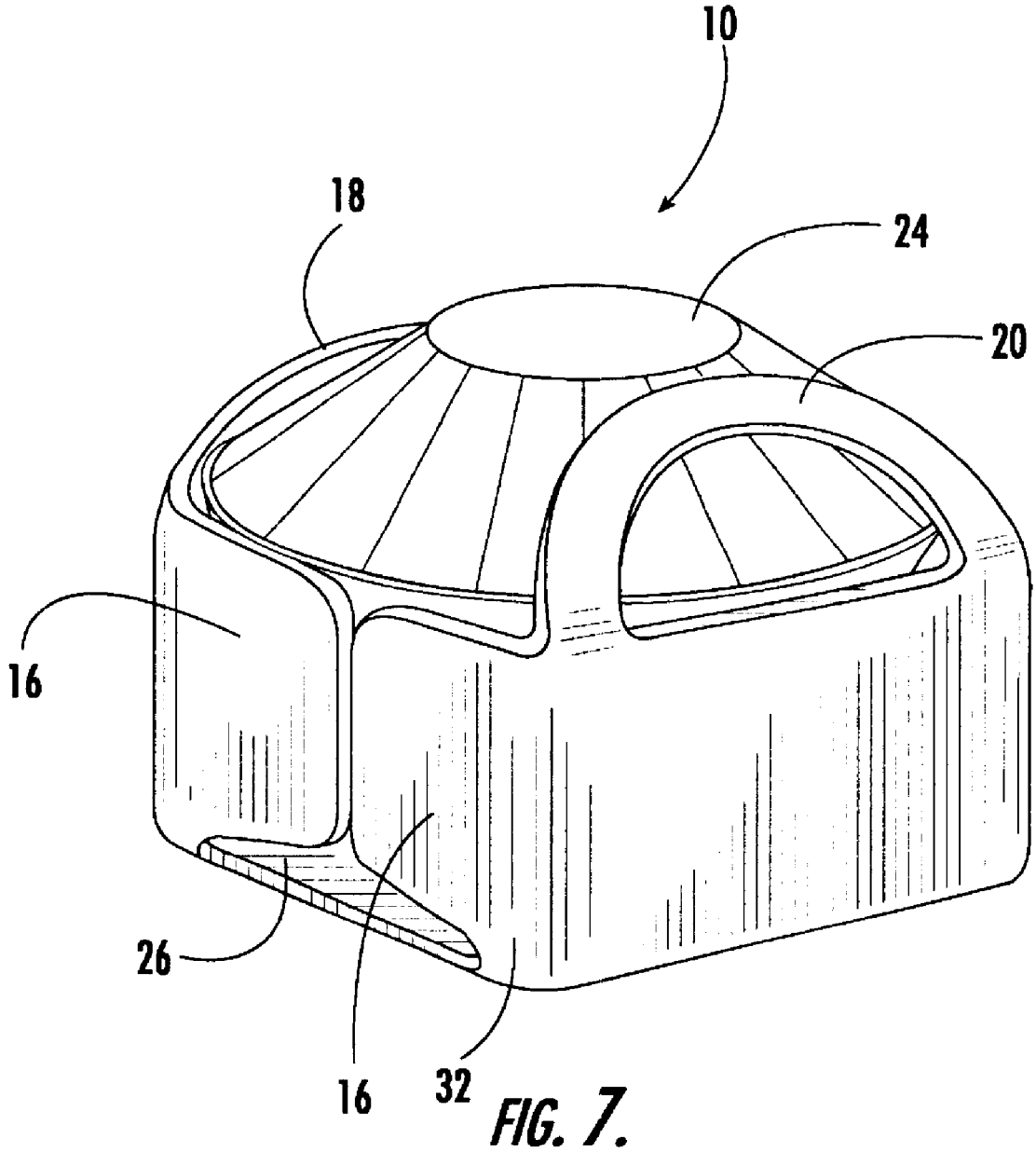
FIG. 7 is a perspective view thereof with a gemstone mounted in place and the setting loops folded down.

Turning now to FIG. 7, the gemstone setting 10 of the present invention is illustrated with a standard brilliant cut gemstone 24 in place. In connection with the preferred application of the setting 10, the gemstone 24 is preferably an artificial rhinestone. While a standard cut gemstone is illustrated herein, it is to be understood that other shapes and cuts of artificial, crystal, precious and semi-precious gemstones can be mounted as well, and the disclosure is not intended to be limited by the preferred embodiment. The gemstone 24 is placed into the opening 26 in the top of the box setting 10. The two arcuate loops 18, 20 are then bent inwardly and downwardly over the edges of the gemstone 24 until they snugly contact the top of the gemstone 18, 20. It can be seen that once the loops 18, 20 are bent into place, there are no protruding ends to become snagged on a fabric. It can also be seen that the only portion of the gemstone 24 that is covered, are two narrow strips under the crescent loops 18, 20. This can be contrasted to several prior art settings where the entire perimeter of the stone is hidden by the perimeter of the setting. In the present invention, the gemstone 24 has a larger appearance because more of the gemstone 24 is exposed to view. Additionally, the gemstone 24 has a brighter appearance because more light can enter the gemstone 24 and be reflected by the gemstone 24.

Figure 3A:
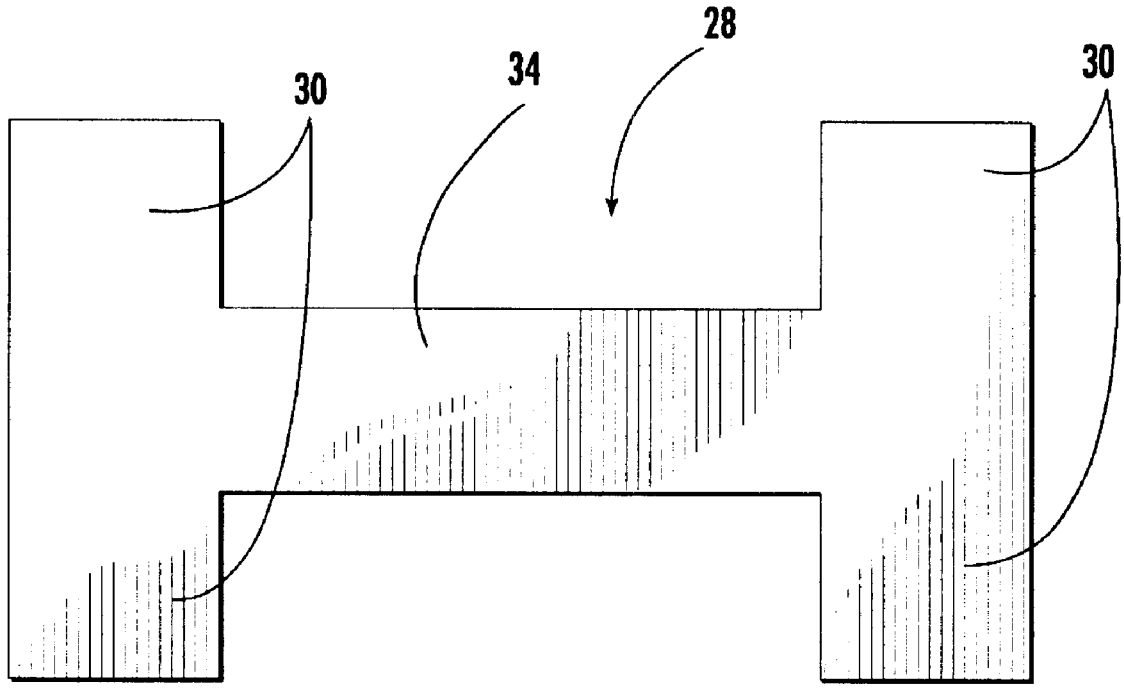
FIG. 3A is a plan view of the stamped blank that forms the linking element to link two box-type settings together in a chain.
Figure 8:
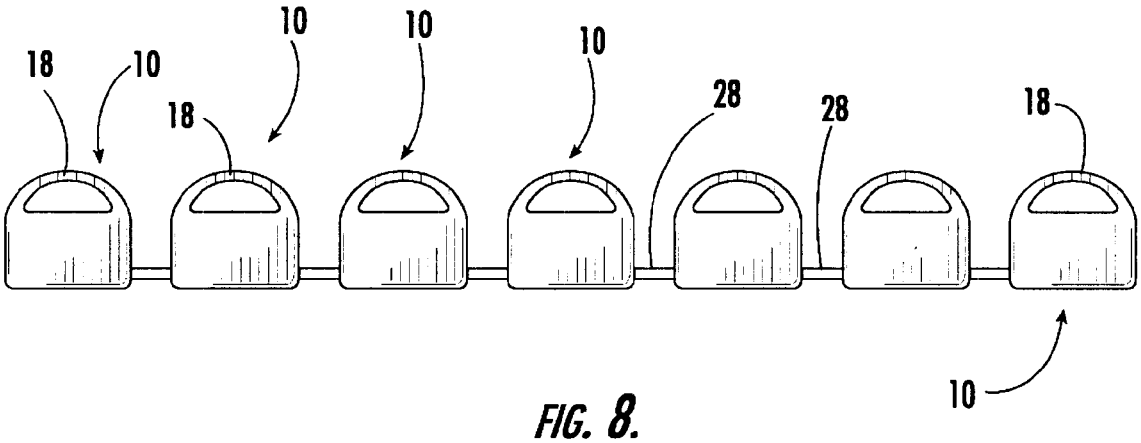
FIG. 8 is a side view of a plurality of the box-type settings of the present invention linked together to form a continuous chain.

Turning to FIG. 8, a plurality of the box settings 10 of the present invention are shown linked together to form a continuous chain. When the box setting 10 of the present invention is folded, the tabs 16 that form two of the sides of the box do not extend entirely to the bottom surface of the box. Since the tabs 16 do not extend all the way to the bottom, a slot 26 is formed in two opposing sides of the box setting 10. This slot 26 is configured to receive an H-shaped linking element 28 as shown in FIG. 3A. On one end of the linking element 28, the two tabs 30 are received inside the box setting 10 and retained by the shoulders 32 beneath the tabs 16. The narrow central portion 34 of the linking element 28 protrudes out through the slot 26 in the side of the box setting 10. In a similar fashion, the other end of the linking element 28 is received in a slot 26 in an adjacent box setting 10, effectively linking two box settings 10 together. This linking process can be repeated to form a continuous chain of any desired length. Once the settings 10 are linked in a chain, the gemstones 24 set in over the top of the tabs 30, further assisting in retaining the linking element 28 within the box setting 10.

The present invention, in completed form, with a gemstone 24 set in place, is then made available to jewelry designers or assemblers for incorporation into a finished article of jewelry. The box setting 10 of the present invention may be incorporated into jewelry as a singular setting or alternatively in continuous chain form such as described above. As can be seen, a great variety of different jewelry articles could incorporate the present invention such as rings, bracelets, necklaces as well as adornment for articles of clothing.

Finally, it should be noted that the main concept of the present invention, i.e. the use of the crescent bendable loops, can be incorporated into other structures with the same effect. It is not necessary that the crescent loops 18, 20 be formed on a box setting 10 to be disclosed under the present invention. For example, the crescent loops 18, 20 could be incorporated onto a ring or other jewelry article to create a prongless setting that falls within the scope of the present invention.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A blank for forming a prongless gemstone setting, said blank comprising:

a central body portion configured to receive a gemstone when formed into said gemstone setting, said central body portion including at least two opposing sides, each of said opposing sides including a terminal edge, each of said terminal edges including a bendable loop member having opposed first and second ends integrally formed with and respectively protruding from said terminal edge in a first normal non-retaining position substantially coplanar with said terminal edge which allows placement of a gemstone within the central body portion, each of said bendable loop members being configured to be bent relative to their respective terminal edges to a second overlying position to retain a gemstone within said central body portion when said blank is formed into said gemstone setting.

2. The blank of claim 1 wherein said central body portion is rectangular and is configured to be formed into a box setting.

3. The blank of claim 2 wherein said central body portion includes opposing top and bottom sides, each of said top and bottom sides having a said terminal edge, each of said ton and bottom terminal edges having a pair of symmetrically opposed tab members integrally formed with and symmetrically protruding from said top and bottom terminal edges.

4. The blank of claim 3 wherein said loop members are arcuate.

5. The blank of claim 2 wherein said loop members are arcuate.

6. The blank of claim 1 wherein said loop members are arcuate.

7. A prongless setting for a gemstone comprising:

a base configured to receive a gemstone therein, said base including at least two opposing sides, each of said sides including a terminal edge; and at least two bendable loop members, each having opposed first and second ends which respectively protrude from a respective terminal edge in a first normal non-retaining position substantially coplanar with said terminal edge which allows placement of a gemstone within the base, said bendable loop members being bendable relative to said base to a second overlying position to retain a gemstone within said base.

8. The prong less setting of claim 7 wherein said base is configured as a box base.

9. The prongless setting of claim 8 wherein said loop members are arcuate.

10. The prongless setting of claim 7 wherein said loop members are arcuate.

11. An article of jewelry comprising:

a prongless setting for a gemstone including a base configured to receive a gemstone therein, said base including at least two opposing sides, each of said sides including a terminal edge; and at least two bendable loop members, each having opposed first and second ends which respectively protrude from a respective terminal edge of said base said bendable loop members each having a first normal non-retaining position substantially coplanar with said terminal edge which allows placement of a gemstone within the base; and a gemstone received in said base of said prongless setting between said at least two bendable loop members, said at least two bendable loop members being bent inwardly and downwardly to a second overlying position over a top portion of said gemstone to retain said gemstone in assembled relation with said base.

12. The article of jewelry of claim 11 wherein said prongless setting is configured as a box prongless setting.

13. The article of jewelry of claim 12 wherein said loop members are arcuate.

14. The article of jewelry of claim 11 wherein said loop members are arcuate.

15. A prongless jewelry chain comprising:

a plurality of prongless gemstone settings, each of said prongless gemstone settings individually comprising a base configured to receive a gemstone therein, each of said bases including at least two opposing sides, each of said sides including a terminal edge, each of said prongless gemstone settings further including at least two bendable loop members, each loop member having opposed first and second ends which respectively protrude from a respective terminal edge of each of said bases, each of said prongless gemstone settings still further including a gemstone received in each of said bases between said at least two bendable loop members, said at least two bendable loop members being bent inwardly and downwardly over a top portion of said gemstone to retain said gemstone in assembled relation with each of said bases; and a plurality of link elements sequentially connecting adjacent ones of said plurality of prongless gemstone settings to form a continuous jewelry chain.

16. The prongless jewelry chain of claim 15 wherein said plurality of prongless settings are configured as a box prongless settings.

17. The prongless jewelry chain of claim 16 wherein said loop members are arcuate.

18. The prongless jewelry chain of claim 15 wherein said loop members are arcuate.

* * * * *